United States Patent [19]

Ouellette et al.

[11] Patent Number: 4,464,130

[45] Date of Patent: Aug. 7, 1984

[54] MULTIPLE DEPTH SELECTOR MECHANISM

[75] Inventors: Charles W. Ouellette; David Edson, both of Portsmouth, R.I.

[73] Assignee: Raytheon Company, Lexington, Mass.

[21] Appl. No.: 309,622

[22] Filed: Oct. 8, 1981

[51] Int. Cl.[3] ..... B63B 21/52

[52] U.S. Cl. ..... 441/25

[58] Field of Search ..... 441/7, 21, 24, 25, 26, 441/29; 242/54 R; 367/3

[56] References Cited

U.S. PATENT DOCUMENTS

| | | | |
|---|---|---|---|
| 3,262,090 | 7/1966 | Farmer | 441/21 |
| 3,818,524 | 6/1974 | Starkey | 441/25 |
| 3,991,475 | 11/1976 | Segrest et al. | 441/24 |

FOREIGN PATENT DOCUMENTS

| | | | |
|---|---|---|---|
| 540558 | 8/1955 | Belgium | 441/24 |

*Primary Examiner*—Trygve M. Blix
*Assistant Examiner*—Jesûs D. Sotelo
*Attorney, Agent, or Firm*—Martin M. Santa; Joseph D. Pannone; Richard M. Sharkansky

[57] ABSTRACT

A sonobuoy depth selector utilizes the tension in the attaching cable between the suspended sonobuoy and the supporting float to select the length of the attaching cable. Bobbins are attached to the cable at predetermined distances from the float. The bobbins are also mounted on a solenoid actuated pin which is tapered to cause only the bobbin resisting the tension in the cable to slide along the pin to a release position near the end of the pin. Momentary electrical energization of the solenoid causes the pin to release only the bobbin under cable tension thereby allowing the cable to pay out from a cable reel until stopped by the bobbin attached to the next larger predetermined length of cable.

9 Claims, 5 Drawing Figures

MULTIPLE DEPTH SELECTOR MECHANISM

BACKGROUND OF THE INVENTION

This invention relates to depth selecting mechanisms and more particularly to a sonobuoy depth selector which permits a selectable predetermined length of line to be paid out from a suspended underwater sonobuoy to a supporting float.

Of the various prior art devices which have been used for suspending or tethering an object at a predetermined distance below the surface of the water or above the ocean bed, a squib operated selector mechanism has been found to be among the most reliable. In operation, the sonobuoy containing a coil of signal cable deploys a float to which one end of the cable is attached. The sonobuoy descends while paying out cable from the cable coil until the shallow operating depth is reached. At this point, an arresting loop attached to the cable and also to the sonobuoy bulkhead is pulled taut and stops the descent of the sonobuoy. The loop passes through a cable cutter which is in turn attached to the sonobuoy bulkhead. Upon receiving a signal from the transceiver contained within the float, the squib fires pushing a piston type cutter which severs the loop. Severing of the loop allows the sonobuoy to descend paying out the remainder of the signal cable coil until a loop connected to the cable near the end of the cable coil is pulled taut. The latter loop is simply wrapped around the body of the cable cutter.

To incorporate a third depth capability utilizing the above technique would require a second cable cutter, which would be difficult to package, along with another bulkhead penetration for the squib electrical lead, which lowers the reliability of water tight integrity. Accordingly, there exists a need for a device which selects more than two depth line lengths at which the sonobuoy may float while providing convenient, reliable operation and which is inexpensive.

SUMMARY OF THE INVENTION

The present invention overcomes the disadvantages and limitations of the prior art line pay-out devices by providing an electrically actuated release mechanism which selectively releases only one bobbin of many bobbins which are secured to the signal cable at the predetermined desired line lengths. In operation, only that bobbin which is under tension from the downward force of the sonobuoy and the upward force of the float on the signal cable is released during each momentary actuation of an electrically operated solenoid. After the sonobuoy descends to the next deeper depth, the bobbin connected to the signal cable at the line length corresponding to that depth is under tension and in a position where it too will be released upon the momentary actuation of the solenoid. The number of bobbins which may be thus released is limited only by the physical dimensions of the bobbins and the space available within the sonobuoy to accommodate them and the solenoid. It is therefore a principal object of the invention to provide a signal cable release mechanism which allows a sonobuoy to be operated at more than two depths. It is a further object of the invention to provide an inexpensive reliable lightweight and compact device for paying out predetermined lengths of line between the sonobuoy and a float.

It is a further object of the invention to provide a multiple depth release mechanism which is capable of being energized by a single solenoid thereby keeping down the number of incursions of the solenoid actuating wire through the bulkhead which separates the sonobuoy electronics compartment from the cable release compartment. It is a still further object of the invention to provide a cable release mechanism through which multiple depths may be obtained by the application of a common signal thereby simplifying the decoding electronics required for the selection of a desired depth. These and other objects will be apparent from the following description of the invention when considered in conjunction with the accompanying drawings.

BRIEF DESCRIPTION OF THE DRAWINGS

The aforementioned aspects and features of the invention are explained in the following description taken in conjunction with the accompanying drawings.

DESCRIPTION OF THE PREFERRED EMBODIMENT

Figure 1:
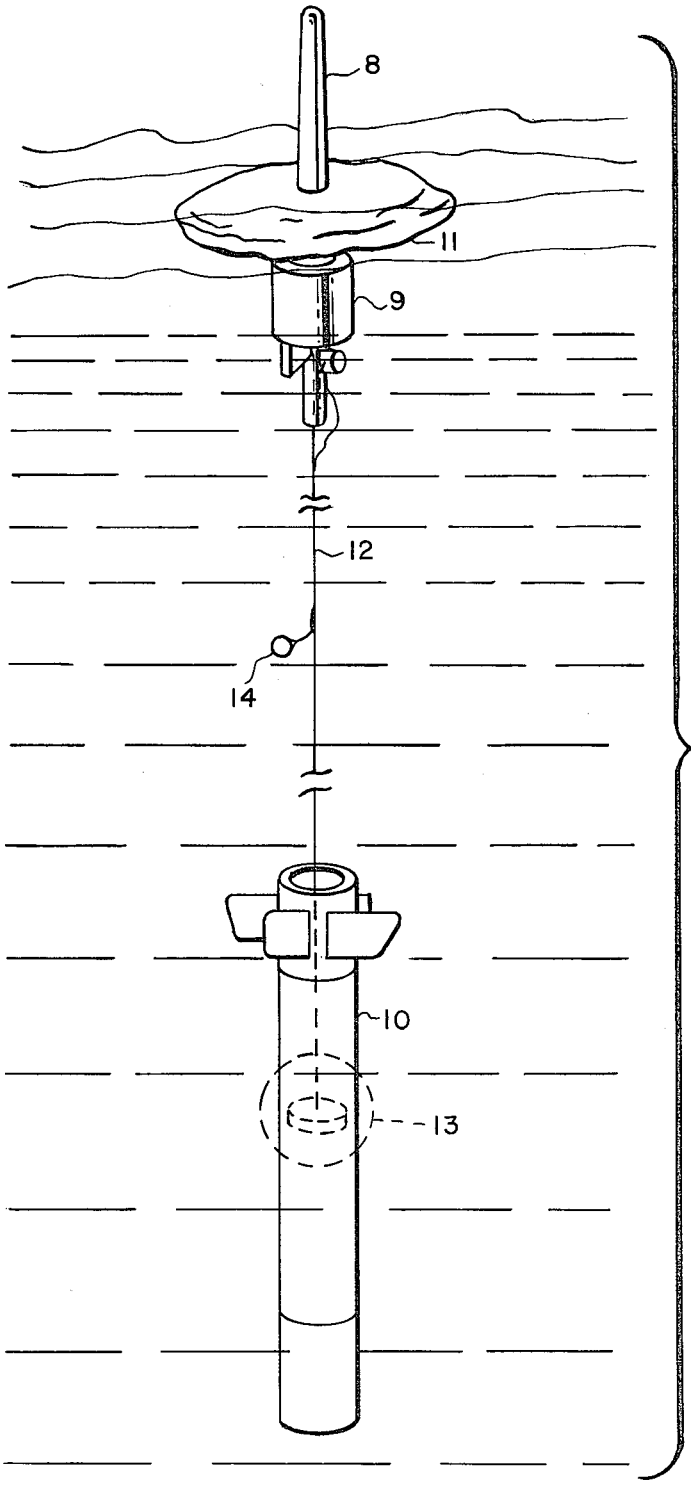
FIG. 1 is a view of a deployed sonobuoy at an intermediate immersion depth.

Referring to FIG. 1 there is illustrated a sonobuoy 10 secured to a float 11 by a cable 12. The sonobuoy 10 is capable of receiving and transmitting information via the cable 12 to the transceiver 9 and antenna 8. When data is to be collected by the sonobuoy 10 at different ocean depths, it is desired that there be a mechanism whereby the sonobuoy in response to received signals will pay out from a reel of cable contained within it predetermined increasing lengths of cable so that data may be obtained from successively deeper depths. In order to select these different depths for sonobuoy operation, the cable release mechanism 13, shown schematically in FIG. 1 and in detail in FIGS. 2–5, is attached to a plurality of rings 14–16 which are in turn attached at the preselected lengths of line or cable 12 corresponding to the preselected depths of operation.

Figure 2:
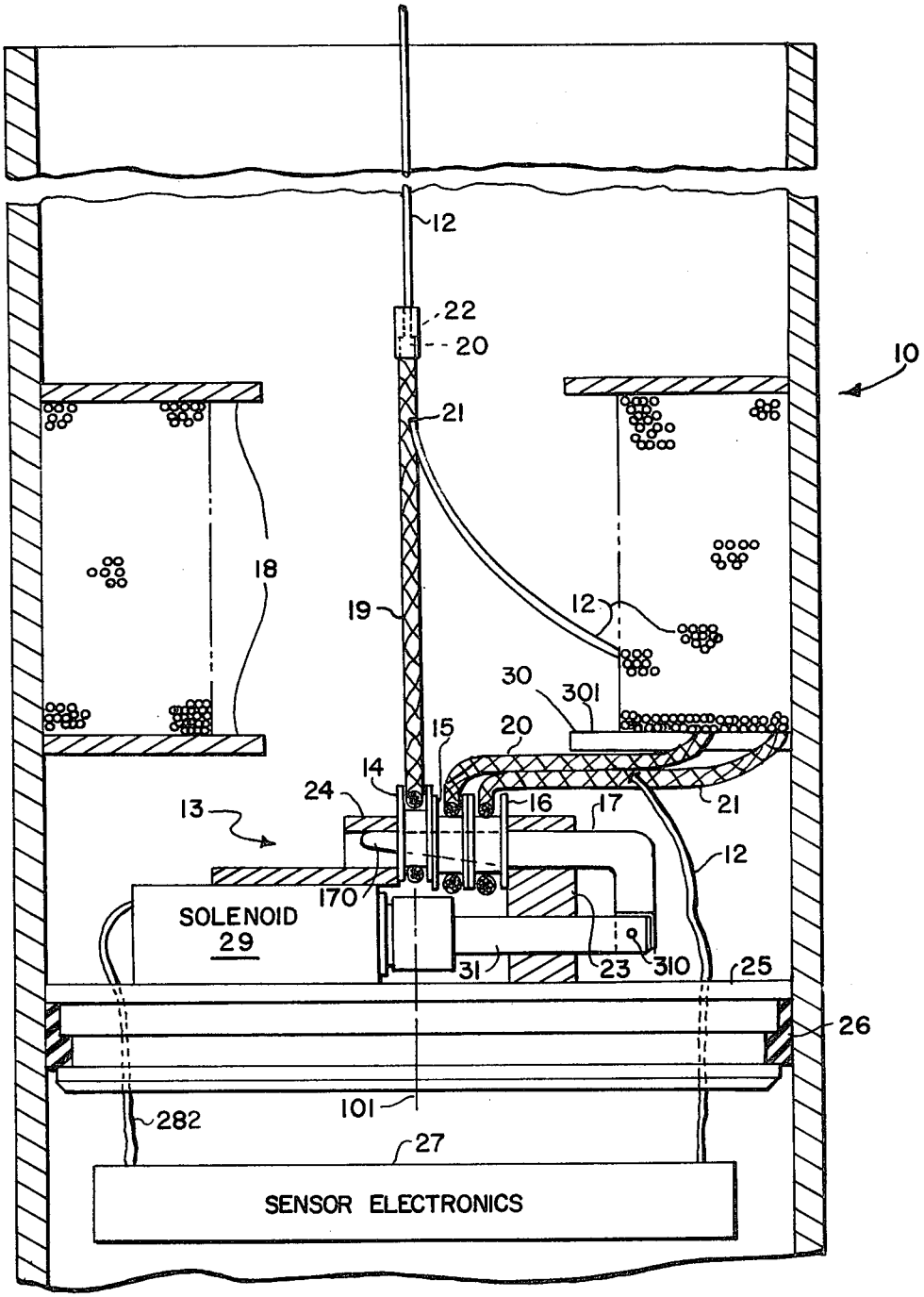
FIGS. 2–5 show partial cross-sectional views of the sonobuoy showing the cable release mechanism in different stages of operation and with different lengths of cable deployed between the float and the sonobuoy.

Referring to FIGS. 2–5 there is shown details of the cable release mechanism 13 at various stages of deployment of the cable 12. FIG. 2 shows the sonobuoy 10 deployed at its shallowest depth with all the rings or bobbins 14, 15 and 16 on the tapered restraining pin 17. In reaching the predetermined minimum depth, the cable 12 has been paid out from the interior portion of cable reel 18 until stopped by bobbin 14, cable 12, and pin 17. Bobbin 14 is attached to the cable 12 by a cord 19 which at one end forms a loop around the bobbin 14. The cord 19 is preferably a woven cord having the property that the application of tension on the cord reduces the cross-section of the cord thereby exerting a frictional force upon the cable 12 which threads through the end 20 of the cord and emerges through the sidewall 21 of the cord. A clamp 22 provides sufficient frictional force between the cable 12 and the end of the cord 19 to cause the cord 19 to elongate and decrease its diameter when under tension. The cable 12 is therefore constrained by the frictional forces imposed by the cord 19 thereby relieving the cable 12 of a concentrated stress which may cause it to break. The cord 19 acts as a "chinese finger" which is a gripping mechanism which has been used in securing cables to sonobuoys in the prior art. The cord 19 which also forms a loop around the bobbin 14 supports the weight of the sonobuoy 10 and is under tension when so supporting the sonobuoy; therefore the other cords 20, 21 are slack. The tension in cord 19 is transmitted to the tapered pin 17 which is reciprocable in a guide member 23 and a seat 24 both of which are attached to the bulkhead 25. Bulkhead 25 is attached to the body of the sonobuoy 10 and contains a seal 26 which seals the sensor electronics 27 portion of the sonobuoy from the water filled portion of the sonobuoy which contains the cable spool or reel 18 and the release mechanism 13. FIG. 2 shows the cords in cross-section at the bobbins.

Figure 3:
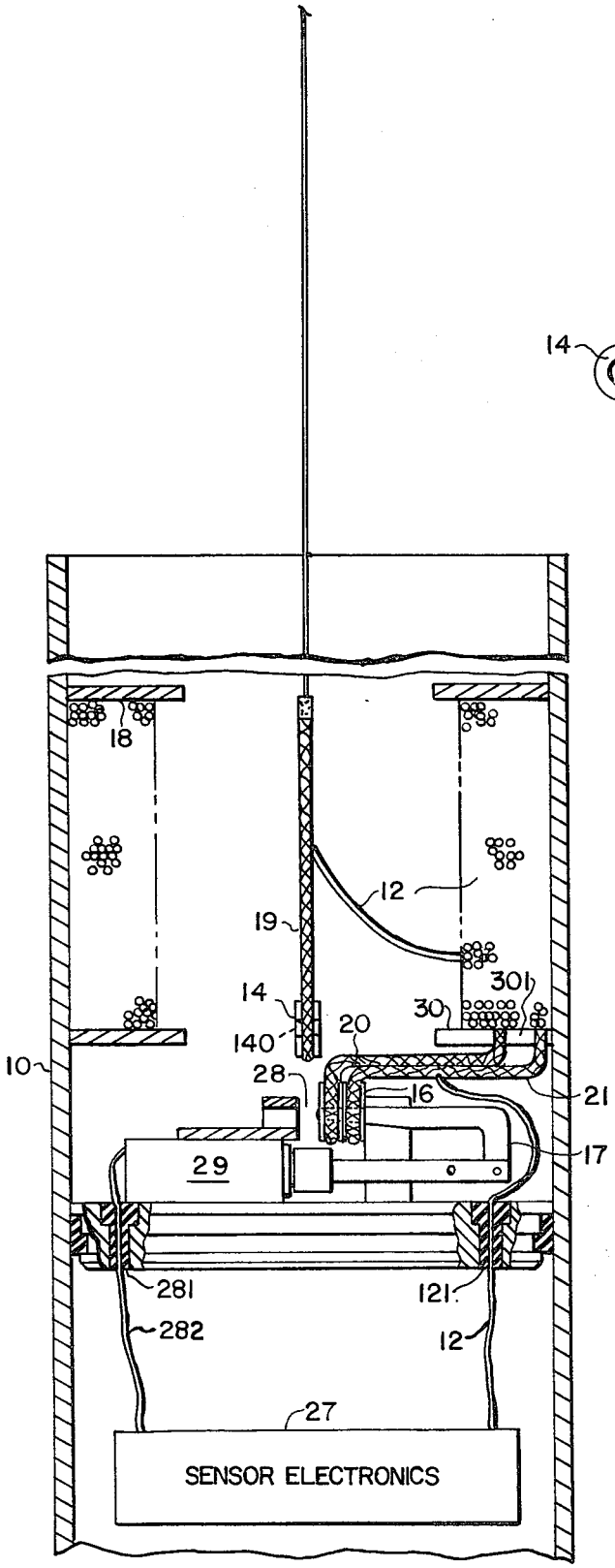
Figure 4:
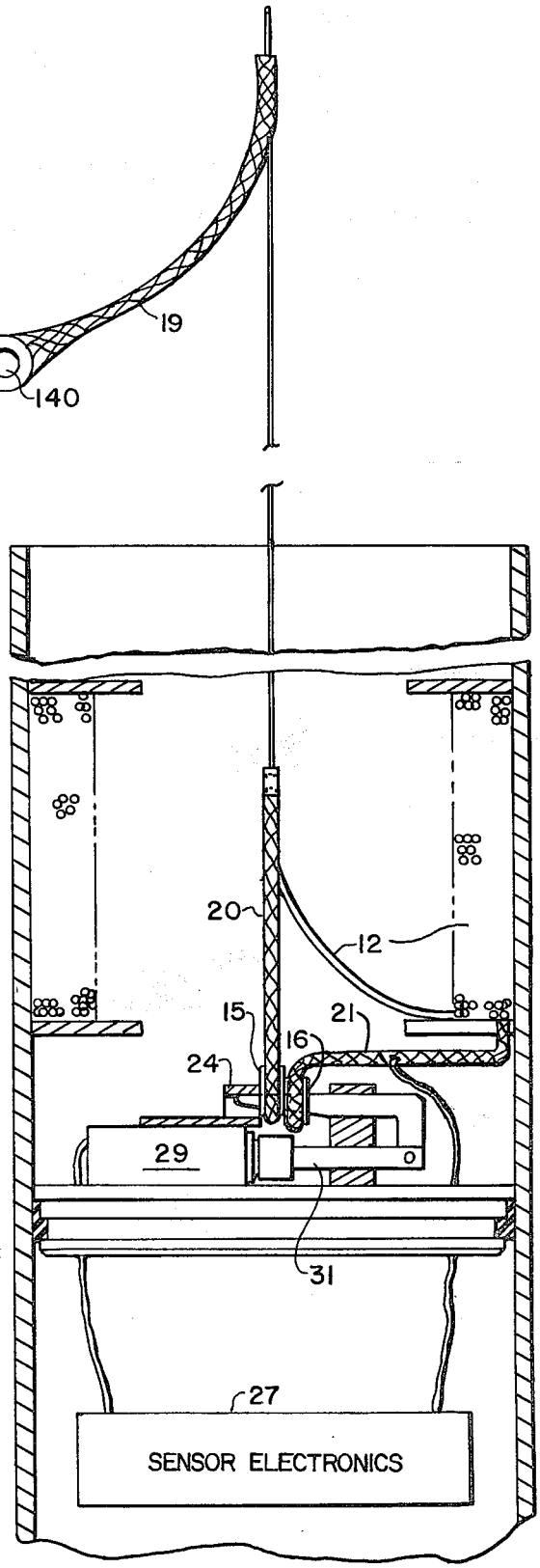

Upon the receipt of a depth command signal by transceiver 11, a signal is provided through cable 12 to the sensor electronics 27 which provides a signal on line 282 to energize solenoid 29. The armature 31 of the energized solenoid 29 is connected to release pin 17 by a hinge 310 and pushes the pin 17 out of its seat 24 by an amount sufficient to allow bobbin 14 to be released by pin 17. Typically, the bobbin is one-eighth of an inch wide nylon whereas the release pin 17 travels approximately five-thirtyseconds of an inch out of its seat 24 to provide the gap or space 28. Therefore, the bobbin 14, being under tension, is pulled through gap 28 as shown in FIG. 3 where pin 17 is shown in its retracted position and bobbin 14 is shown just after release. Upon release of bobbin 14 the sonobuoy 10 will begin to descend paying out cable 12 from the interior portion of the spool 18. Upon release of the bobbin 14 the energization of the solenoid 27 is terminated and a spring contained within solenoid 27 causes the return of pin 17 within guide 23 into seat 24. During the time that the pin 17 is in the retracted position, the bobbins 15 and 16 not being under tension are not released. The cords 20, 21 provide sufficient force on the bobbins 15, 16 in the direction away from the gap 28 through which the bobbin 14 has been released to prevent the inadvertent release of bobbins 15, 16. The spring return of the armature 31 of solenoid 27 returns the pin 17 to its seated position in seat 24 as shown in FIG. 4 approximately 300–400 milliseconds after the solenoid 27 is deactivated. Activation of the solenoid causing pin 17 to move to form the gap 28 is for a period of only a few seconds. Therefore, the untensioned bobbins remain substantially immobile during the short cycle time of pin 17.

As the sonobuoy 10 descends after the release of bobbin 14, the cable 12 continues to pay out from the spool 18 until the second determined depth is reached. At this point, the cord 20 attached to cable 12 in the same manner as cord 19, is pulled inwardly along the guide slot 301 of cable spool end plate 30. The cord 20 with its bobbin 15 is pulled taut against pin 17 as shown in FIG. 4. Pulling taut the cord 20 causes the bobbin 15 to slide along the tapered release pin 17 to the center of the bulkhead where the bobbin 15 is stopped by the seat 24. The remaining bobbin 16 may or may not slide to the position shown in FIG. 4. Whether it does or does not is immaterial since the cord 21 is slack and hence not then being used.

Figure 5:
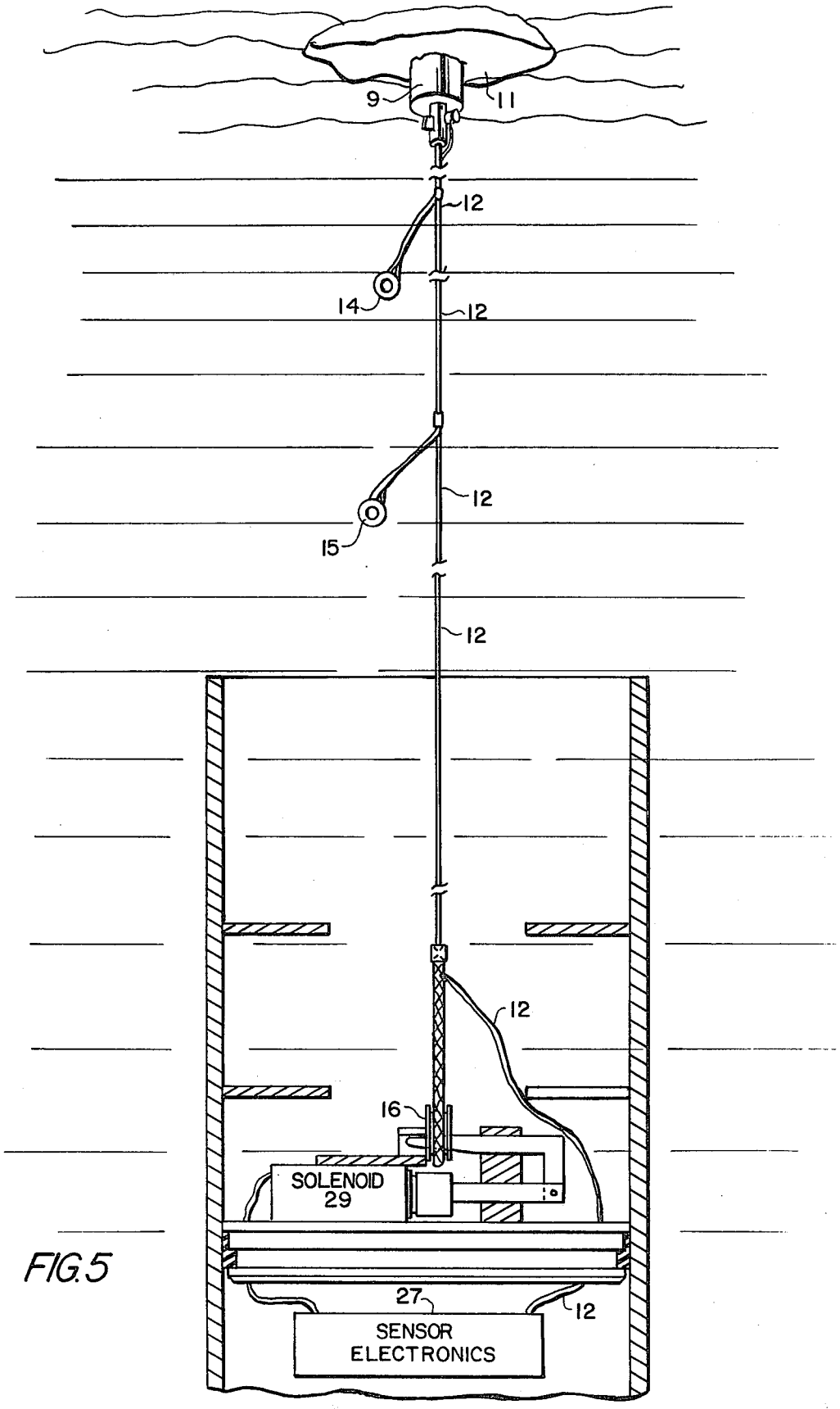

At another depth command received by transceiver 11 the solenoid 29 is again actuated to release the tensioned bobbin 15. After the bobbin 15 is released, the solenoid 29 is deenergized and pin 17 returns to its seated position and the sonobuoy 10 descends paying out cable 12 until the third cord 21, which is similarly attached to cable 12 slides along guide slot 301 and is pulled taut by bobbin 16 and pin 17 as shown in FIG. 5. At this time the maximum depth has been reached and the cable 12 has been totally removed from its spool 18.

In order to prevent the accidental release of the last bobbin 16 by another inadvertent depth command, the release solenoid 29 is arranged, as in the prior art, to ratchet a switch contained within it so that after a predetermined number (in the preferred embodiment the number is two) of actuations of the solenoid, the solenoid is electrically disconnected and unresponsive to further energization signals from the sensor electronics 27. Alternatively in this invention, release of the last bobbin 16 can be prevented by making the last bobbin 16 at least slightly wider than the width of the gap 28 opening so that a conventional nonratcheting solenoid may be used because even if solenoid 29 is actuated, bobbin 16 will not be released.

Although the invention has been described with three bobbins which provides three depths at which the sonobuoy 10 can operate, it is seen that the number of depths is limited only by the number of bobbins which can be accommodated on the pin 17. The bobbins are preferably made of nylon because of the low friction of nylon. The center hole 140 of the bobbins, the pin 17, its tapered portion 170, solenoid armature 31 and the holes in guide 23 and seat 24 through which the pin and armature slide are preferably circular to minimize friction and for ease of fabrication. The pin 17 is connected by hinge 310 to the solenoid armature 31 thereby relieving the solenoid armature from any transverse force which is produced by the tensioned cable 12 acting upon pin 17. The maximum depth is limited by the length of cable 12 which may be carried by the sonobuoy 10. Gaskets 121 and 281 prevent water in the cable carrying portion of the sonobuoy to penetrate past wires 12 and 28, respectively, into the sensor electronics portion 27 of the sonobuoy.

It should be noted that the seat 24 is located near the longitudinal center of sonobuoy 10 so whichever of the cords 19–21 is in tension lies along the center line 101 of sonobuoy 10 in order to provide support along the line of greatest stability of the sonobuoy.

Although the invention has been described in terms of a float supporting a sonobuoy at different prescribed depths, it will be apparent that the invention is equally applicable to controlling a float at a predetermined distance from the ocean bottom where the release mechanism may be contained in the anchor rather than the float and is actuated by signals which are received from a surface float or through underwater communications techniques.

Having described a preferred embodiment of the invention it will now be apparent to one of skill in the art that other embodiments incorporating its concept may be used. It is felt, therefore, that this invention should not be restricted to the disclosed embodiment but rather should be limited only by the spirit and scope of the appended claims.

What is claimed is:

1. A device for paying out a sequence of predetermined lengths of line from a spool of line comprising:

a plurality of attaching means in contact with each other connected to said line at points corresponding to said predetermined lengths of line;

a tensioning means attached to one end of said line;

a securing means;

means for successively actuating said securing means;

said securing means comprising an electrically operated solenoid having a release pin, said pin being releasably attached to said attaching means to prevent the attaching means from being released from said securing means when said solenoid is unenergized, said pin moving in response to energization of said solenoid to allow only the attaching means attached to that portion of the predetermined length of line under tension by said tensioning means to be released by said pin;

said tensioning means causing the next longer predetermined length of line to become tensioned and to position its attaching means on said securing means such that the next actuation of said securing means will release only said next longer line length attaching means from said pin.

2. The device of claim 1 comprising in addition:

a pin seat in which said pin is seated when said solenoid is unenergized, the attaching means secured to said tensioned line and said pin being located against said pin seat;

said pin movement in response to energization of said solenoid providing a gap between the end of said pin and said seat;

said attaching means being sufficiently small to pass through said gap when said solenoid is energized and said attaching means is connected to the line under tension.

3. The device of claim 2 wherein said pin is a tapered pin, so tapered that the attaching means connected to the line under tension slides along the pin until stopped by the pin seat.

4. The device of claim 3 wherein said attaching means comprises a bobbin in contact with said tapered pin having a width which is less than the width of the gap provided by the energized solenoid.

5. An underwater sonobuoy with a floating antenna to which the electronic instrumentation of said sonobuoy is connected by an electrically conducting cable, said sonobuoy adapted to receive and provide information to said antenna at a plurality of preselected increasing depths corresponding to preselected increasing lengths of said cable, a cable payout device mounted in said sonobuoy comprising:

a reel of cable, said cable having rings attached to the cable at said plurality of preselected lengths of said cable;

electromagnetic releasing means having a pin for retaining said rings;

a float carrying said floating antenna;

said cable between said float and one of said rings being under tension when said sonobuoy is deployed in water;

means responsive to each one of a succession of signals from said antenna for remotely electrically actuating said releasing means to move said pin to the same release position for each signal of said succession of signals while said sonobuoy is deployed in water such that said ring under cable tension is released from said pin, while said rings which are not under tension remain on said pin.

6. The device of claim 5 comprising in addition:

a pin seat in which said pin is seated when said releasing means is unenergized, the ring secured to said tensioned line and said pin being against said pin seat when in said release position;

said pin movement in response to energization of said releasing means providing a gap between the end of said pin and said seat;

said ring width being sufficiently small to pass through said gap when said releasing means is energized and said ring is connected to the line under tension.

7. The device of claim 6 wherein said pin is a tapered pin so tapered that the ring connected to the line under tension slides along the pin until stopped by the pin seat.

8. A device for paying out predetermined increasing lengths of line from a coil of line in response to a succession of electrical signals comprising:

a releasing means;

means for securing said line by said releasing means at predetermined points along said line corresponding to said predetermined lengths;

means for producing tension in said line at one of said predetermined points;

means remotely actuating said releasing means in response to each of said succession of electrical signals for a time sufficient to release said tensioned line only at the predetermined secured point of said tensioned line nearest said tension producing means;

said tension producing means pulling a predetermined length of said line from said coil until said line is tensioned upon reaching the next secured point of said line attached to said deactivated releasing means.

9. The device of claim 8 wherein said releasing means comprises an electrically actuated solenoid having a pin slidable in a seat, said pin being responsive to actuation of said solenoid to slide free of said seat and thereby provide an opening to release said predetermined point of said line under tension;

said pin returning to its seat upon deactivation of said solenoid;

said line being paid out from said coil until the next predetermined length of line is under tension at a secured point in proximity to said seat.

* * * * *